US006010211A

United States Patent [19]

Betschon

[11] Patent Number: 6,010,211

[45] **Date of Patent: *Jan. 4, 2000**

[54] INK JET CARTRIDGE WITH MEMBRANE VALVE

[75] Inventor: Luzius Betschon, Uster, Switzerland

[73] Assignee: Pelikan Produktions AG, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/761,541

[22] Filed: Dec. 6, 1996

[30] Foreign Application Priority Data

Dec. 7, 1995 [DE] Germany ..... 195 45 775

[51] Int. Cl.[7] ..... B41J 2/175

[52] U.S. Cl. ..... 347/86

[58] Field of Search ..... 347/5, 6, 84, 85, 347/86; 137/247.11, 247.13, 247.17, 248; 126/99 R; 604/240

[56] References Cited

U.S. PATENT DOCUMENTS

| | | | |
|---|---|---|---|
| 4,253,103 | 2/1981 | Heinzl et al. | 347/86 |
| 5,359,356 | 10/1994 | Ecklund | 347/86 |
| 5,524,606 | 6/1996 | Le Strat | 126/99 R |
| 5,746,724 | 5/1998 | Powles et al. | 604/240 |

FOREIGN PATENT DOCUMENTS

| | | | |
|---|---|---|---|
| 0238829 A2 | 9/1987 | European Pat. Off. . | |
| 0519457 A2 | 12/1992 | European Pat. Off. . | |
| 0709207 A2 | 5/1996 | European Pat. Off. . | |
| 0709207A2 | 1/1996 | Japan | B41J 2/175 |

*Primary Examiner*—N. Le
*Assistant Examiner*—Anh T. N. Vo
*Attorney, Agent, or Firm*—Fay, Sharpe, Fagan, Minnich & McKee, LLP

[57] ABSTRACT

An ink cartridge for an ink jet printer has a housing containing an ink storage space. An upper portion of the ink storage space is closed off by a cup-shaped membrane. A pressure reduction valve is built into a housing bottom. The storage space communicates via the pressure reduction valve with a chamber which has an opening sealed by a rubber plug. During installation of the cartridge in the print head, the rubber plug is pierced by a hollow needle so that ink may pass from the chamber to the print head. The reduction valve ensures a predetermined underpressure in chamber. This facilitates reliable operation of the print head, even with fluctuating ambient temperature, and provides efficient space utilization within the housing.

20 Claims, 1 Drawing Sheet

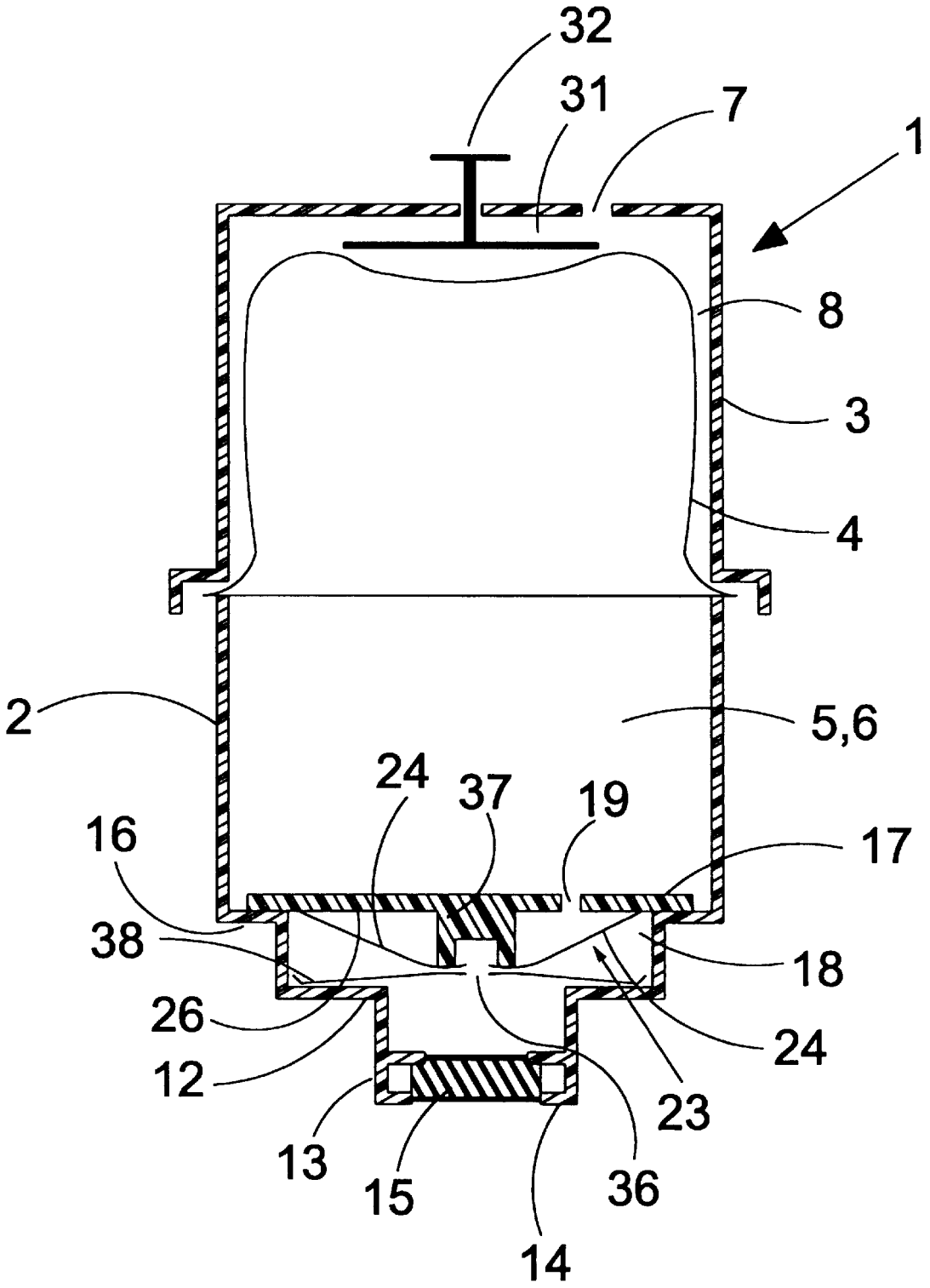
32
31
7
1
8
3
4
2
5,6
24
37
19
16
17
38
18
26
24
12
23
13
15
36
14

INK JET CARTRIDGE WITH MEMBRANE VALVE

BACKGROUND OF THE INVENTION

The subject invention is directed toward the art of ink jet printers and, more particularly, to an improved ink jet cartridge for a print head of an ink jet printer.

Ink cartridges for ink jet printers generally include a housing containing a bag filled with ink. One such cartridge is shown in EP-A-519457 in which the edge of an aperture of the ink filled bag is imperviously sealed with a protrusion on the bottom of the housing. On the protrusion there is mounted a vacuum valve in the form of a slotted bubble. The valve is arranged between the interior of the bag and a small chamber, which is closed off in the bottom of the housing by means of a sealing plug. During installation of the cartridge in a print head, the plug is pierced by a hollow needle. The print head is then supplied with ink from the bag via the valve and the chamber. The slotted bubble ensures a certain underpressure in the chamber so that the ink does not run out of the print head. With growing underpressure, the slotted bubble becomes deformed so that the slot opens and additional ink flows into the chamber and thus to the print head. However, the underpressure in the chamber generated within the slotted bubble is not accurately adjustable because it depends upon many factors, such as material, shape, wall thickness of the bubble, positioning of the slot, etc.

Another ink jet print head ink cartridge including a bag which holds ink and a vacuum valve between the interior of the bag and a smaller chamber communicating with the orifice plate is shown in EP-A-238829. In this case, the vacuum valve consists of a mushroom-shaped, elastomer body whose central region or stem is fastened to a bottom surface of a valve seat. The periphery of the plate-shaped portion of the elastomer body abuts, under pre-stress, the underside of the valve seat. The valve seat has penetration openings about its periphery through which the ink passes from the interior of the bag to the smaller chamber. With this ink cartridge, the adjustment of the desired underpressure in the smaller chamber below the vacuum valve is relatively imprecise, inasmuch as the ink flows through the weakest point along the relatively long periphery of the plate-shaped elastomer body.

SUMMARY OF THE INVENTION

The object of the present invention is to provide an ink cartridge in such manner that the opening pressure of the vacuum valve is readily reproducible and constant over a long period of time.

According to the present invention, the cartridge includes a housing with a storage space for containing ink. A closing element in a first opening in the housing is provided for positioning on a connection piece of a droplet generator. A chamber having a significantly smaller volume than the storage space communicates with the first opening. An intermediary wall separates the chamber from the storage space, and a pressure reducing valve controls the flow of ink between the storage space and the chamber. The valve includes a membrane having an exterior edge tightly connected with the intermediary wall. A penetration opening in the membrane is pressed by a spring against a frontal surface of a protrusion of the intermediary wall.

According to a further aspect of the present invention, a second flexible membrane closes off an upper end of the storage space to maintain the storage space free of air. A ramming tool may be activated to generate excess pressure in the storage space to facilitate start-up.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawing which forms a part hereof, and wherein:

The sole FIGURE is a schematic cross-section through an ink cartridge.

DETAILED DESCRIPTION OF THE PREFERRED EMBODIMENT

Referring now to the drawing wherein the showings are for the purposes of illustrating the preferred embodiment of the invention only and not for purposes of limiting same, the cartridge according to the FIGURE has a housing 1 with a cup-shaped lower portion 2 and an inverted cup-shaped upper portion 3. Between the lower portion 2 and the upper portion 3 there is welded a gas-tight, cup-shaped membrane 4 of a composition foil which is preferably made of PE-EVOH-PE. The membrane 4 performs a blocking effect against diffusion of gas. Between the membrane 4 and the lower portion 2, a storage space 5 is formed which is entirely filled with ink 6, i.e., it contains no air. The upper portion 3 includes an air supply opening 7, which connects a space 8 above the membrane 4 with the atmosphere. In the storage space 5, approximate atmospheric pressure prevails irrespective of the presence of the ink supply. In other words, the pressure at the lower end of the storage space 5, depending upon stock volume, fluctuates between approximately 4 and 0 mbar. A bottom end 12 of the lower part 2 is graduated and has a protrusion 13 with an opening 14 in which an elastomer sealing plug 15 is imperviously positioned. When installing the cartridge in the print head, the sealing plug 15 is pierced by means of a hollow needle of the print head so that a connection is produced from the storage space 5 to the print head to deliver the ink to the print head. The bottom end 12 also includes a step 16 on which an intermediary wall 17 is placed and hermetically sealed or welded to the wall. Between the bottom end 12 and the intermediary wall 17, a chamber 18 is formed whose volume is significantly smaller than the initial volume of the storage space 5. The intermediary wall 17 has an eccentrically formed penetration opening 19 for the ink to pass from the storage space 5 to the chamber 18.

Between the bottom end 12 and the intermediary wall 17, a pressure reducing valve 23 is installed. The valve 23 includes a membrane 24 which is tightly connected, along its external edge, with an underside 26 of the intermediary wall 17. The membrane 24 may be attached in a known manner to form a seal, for example, the membrane may be sealed onto the intermediary wall 17. The membrane 24 has a bore 36 whose edge abuts against the front surface of a cylindrical protrusion 37 of the intermediary wall 17 which acts as a valve seat. The edge of the bore 36 is pressed against the front surface of the protrusion 37 by means of a metal cup spring 38.

In order to facilitate start-up of the print head following installation of a new cartridge, a plate-shaped ramming tool 31 can be provided above the membrane 4, which can be pressed in by means of a pusher 32, in order to produce excess pressure in the storage space 5.

During operation, valve 23 is opened when the underpressure in chamber 18 exceeds a given value. As a result, the underpressure in chamber 18 can be kept at practically a constant value. Temperature and environmental changes do not have any effect on the underpressure so that the cartridge operates reliably.

The materials for the housing 1 and the membranes 4, 24 can easily be selected in such manner so that any type of known ink can be used in the present invention. As a result, the cartridge is highly versatile in its application. The cartridge has a high capacity since, except for the very small volume of the chamber 18, practically the entire interior of housing 1 forms the storage space 5.

In the event that a small amount of air should enter into the chamber 18 during installation of the cartridge, there is no effect of an increase in temperature because the extremely small volume change of said small air volume is absorbed by the elasticity of member 24. Thus, the membrane 24 has a dual function. On the one hand, the membrane 24 regulates the underpressure in chamber 18 during operation, and on the other hand, it off-sets minor volume changes with rising temperature. Because of the metal spring 38, the closing force of valve 23 is readily reproducible and is constant over a long period of time. The closing force of the metal spring 38 is dimensioned in such manner that the underpressure in chamber 18 is approximately 3–20 mbar, preferably approximately 5–9 mbar.

The invention has been described with reference to a preferred embodiment. Obviously, modifications and alterations will occur to others upon a reading and understanding of this specification.

What is claimed is:

1. An ink cartridge for a printer comprising:

a housing having therein a storage space for containing ink, a first opening in the housing for dispensing said ink, and a second opening in the housing for allowing a supply of air into an air-intake area inside the housing;

a closing element positioned in the first opening through which an ink supplying coupling is made with a print head of the printer;

a chamber within the housing having a significantly smaller volume than the storage space, said chamber being in fluid communication with the first opening;

an intermediary wall positioned between the chamber and the storage space, the intermediary wall having an opening therein and a protrusion extending from the intermediary wall;

a pressure reduction valve adapted to regulate ink flow between the storage space and the chamber, the valve including a first membrane having an outer peripheral edge tightly connected to the intermediary wall, said first membrane further defining a bore disposed adjacent said protrusion; and, a spring adapted to bias an outer peripheral edge of said bore against the protrusion of the intermediary wall.

2. The cartridge of claim 1, wherein the spring is made of metal.

3. The cartridge of claim 1, wherein a pressure difference between a pressure in the storage space and a pressure in the chamber, generated by the pressure reduction valve, amounts to 3–20 mbar.

4. The cartridge of claim 1, wherein the spring is a cup-shaped spring.

5. The cartridge of claim 1, wherein the storage space at an end opposite the first opening is closed off by a second membrane, said second membrane forming a barrier between the storage space and air-intake area such that the storage space is maintained free of air.

6. The cartridge of claim 5, further including a ramming tool disposed in the air-intake area, the ramming tool being adapted to be advanced to induce pressure in the storage space.

7. The cartridge of claim 5, wherein the second membrane is formed by a composition foil.

8. The cartridge of claim 7, wherein the composition foil is made of PE-EVOH-PE.

9. The cartridge of claim 7, further including a ramming tool disposed in the air-intake area, the ramming tool being adapted to be advanced to induce pressure in the storage space.

10. An ink cartridge for a printer comprising:

an ink cartridge housing including an ink storage space and a chamber separated by a wall having an opening allowing ink to pass between the storage space and the chamber; and, a pressure reducing valve controlling a flow of said ink between the storage space and the chamber, the pressure reducing valve including:

a protrusion formed on the wall of said opening;

a first membrane sealed to the wall about an outer peripheral edge of the first membrane, the first membrane defining a bore formed adjacent the opening; and, a spring member pressing a peripheral edge of said bore against the protrusion formed on the wall to selectively seal the storage space from the chamber when the peripheral edge of the bore is engaged with said protrusion and open the chamber to the storage space when the peripheral edge of the bore is disengaged from said protrusion.

11. The cartridge of claim 10, wherein the housing includes an air inlet opening and a second membrane provided within the housing to prevent air that has entered through the air inlet opening from entering the storage space.

12. The cartridge of claim 11, further including a ramming tool positioned between the second membrane and the housing, said ramming tool being adapted to be advanced to generate excess pressure within the storage space.

13. An ink cartridge comprising:

a housing defining an ink storage space and a chamber separated from the storage space by a wall having an opening for allowing said ink to pass between the ink storage space and the chamber; and, a pressure reducing valve including:

a first flexible membrane sealed to the wall about an exterior edge of the first membrane, the first membrane defining a bore formed through the membrane; and, a spring member adapted to bias an outer peripheral edge of said bore against said wall to selectively regulate a flow of said ink between said ink storage space and said chamber.

14. The ink cartridge according to claim 13 wherein said spring member is adapted to bias an outer peripheral edge of said bore against said wall to selectively regulate said flow of said ink between said ink storage space and said chamber based on a pressure difference between said ink storage space and said chamber.

15. The ink cartridge according to claim 14 wherein the spring member is adapted to bias the outer peripheral edge of the bore against the wall to selectively regulate said flow of said ink between said ink storage space and said chamber based on a pressure difference of about 3–20 mbars between said ink storage space and said chamber.

16. The ink cartridge according to claim 14 wherein the spring member is formed of metal.

17. The ink cartridge according to claim 14 wherein:

the housing defines a protrusion extending from said wall;

the bore defined by the first membrane is disposed adjacent said protrusion formed on said wall of said housing; and, said spring member is adapted to bias said outer peripheral edge of said bore against said protrusion to selectively seal the ink storage space from said chamber when the peripheral edge of the bore is engaged with said protrusion and to open the chamber to the ink storage space when the peripheral edge of the bore is disengaged from said protrusion.

18. The ink cartridge according to claim 13 wherein the housing defines an air supply opening and wherein the ink cartridge further includes a second membrane forming a barrier between said ink storage space and the air supply opening such that the ink storage space is maintained free of air.

19. The ink cartridge according to claim 18 wherein the second membrane is formed of a composition foil.

20. The ink cartridge according to claim 19 further including a ramming tool carried by the housing, the ramming tool being adapted to be selectively advanced towards said second membrane to induce an increased pressure within said ink storage space.

* * * * *